US005763797A

United States Patent [19]

Loendorf

[11] Patent Number: 5,763,797

[45] Date of Patent: Jun. 9, 1998

[54] BASS DRUM MUTE

[76] Inventor: David J. Loendorf, 12 Vine St., Freehold, N.J. 07728

[21] Appl. No.: 632,996

[22] Filed: Apr. 16, 1996

[51] Int. Cl.[6] ..... G10D 13/02

[52] U.S. Cl. ..... 84/411 M

[58] Field of Search ..... 84/411 M, 411 P, 84/411 A, 411 R

[56] References Cited

U.S. PATENT DOCUMENTS 2,078,004 4/1937 Lebow ..... 84/411 M 4,745,839 5/1988 Peraino ..... 84/411 M

*Primary Examiner*—Cassandra C. Spyrou

*Attorney, Agent, or Firm*—Arthur M. Peslak

[57] ABSTRACT

A device for muting the sound emanating from a bass drum is disclosed. The device is attached to the rim of the bass drum and provides a striking surface that allows the drummer to practice without all of the sound volume normally generated by the drum but still allowing for the natural tone of the drum and response of the drum head.

3 Claims, 5 Drawing Sheets

BASS DRUM MUTE

BACKGROUND OF THE INVENTION

The present invention is directed to the field of musical instruments. In particular, the present invention is directed to a device used to mute the sound emanating from a bass drum. This type of device is used during practice so that the drummer can practice with the actual drum while reducing the volume of sound generated by the drum. These devices allow the drummer to get the response and tone of the actual drum without distorting the natural tone of the drums. While drum mutes have been available for snare or tom drums, similar devices have not been been readily adaptable to a bass drum because of its large size. In addition, since the position of the batter head on a bass drum is vertical, a different type of fastening system is required in contrast to drums with horizontally oriented batter head such as a snare drum.

SUMMARY OF THE INVENTION

The present invention is directed to providing a mute adapted for use with a bass drum. The invention includes a device for muting the sound emanating from a bass drum comprising: a support means, a sound muting means, mounted to the support means and in contact with a face of the bass drum batter head, for muting the sound emanating from the bass drum when the sound muting means is struck by a beater; and a connecting means slidingly mounted on the support means for mounting the device on a hoop of the bass drum.

DETAILED DESCRIPTION OF THE INVENTION

Figure 1:
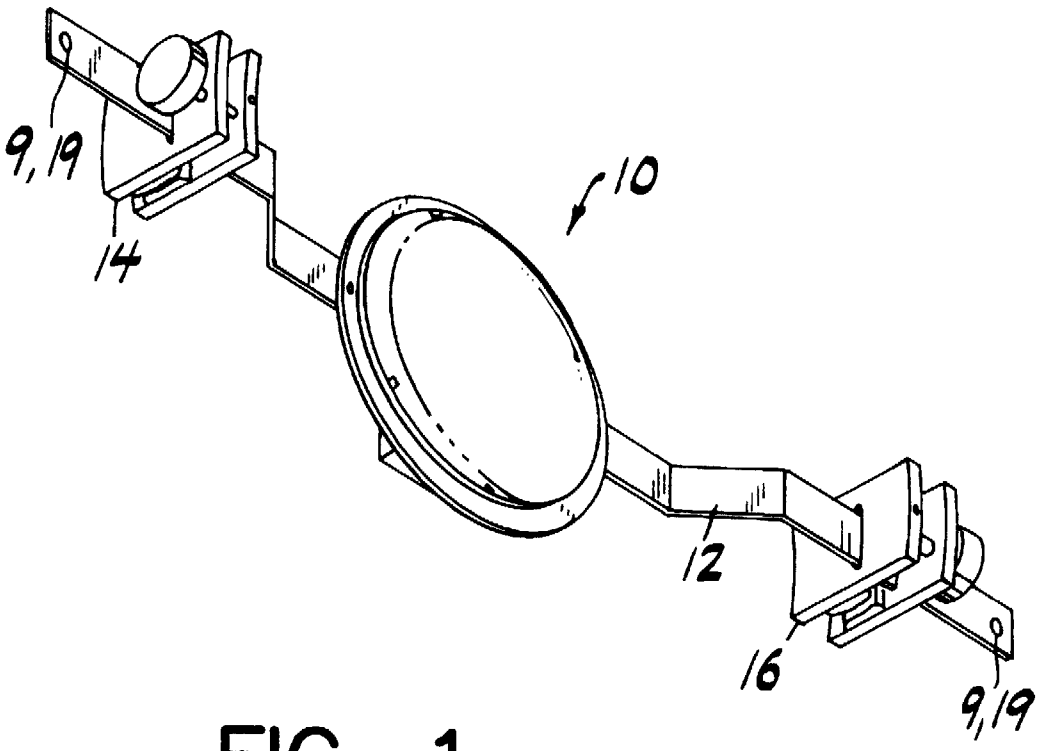
FIG. 1 is a plan view a drum mute of the present invention.

FIG. 1 illustrates a drum mute 10 made in accordance with the present invention. The drum mute 10 comprises a support frame 12 onto which the other components of the drum mute 10 are mounted. In this embodiment, the support frame 12 is fabricated from Lexan. Support frame 12 comprises three arm sections 13, 15 and 17.

Figure 2:
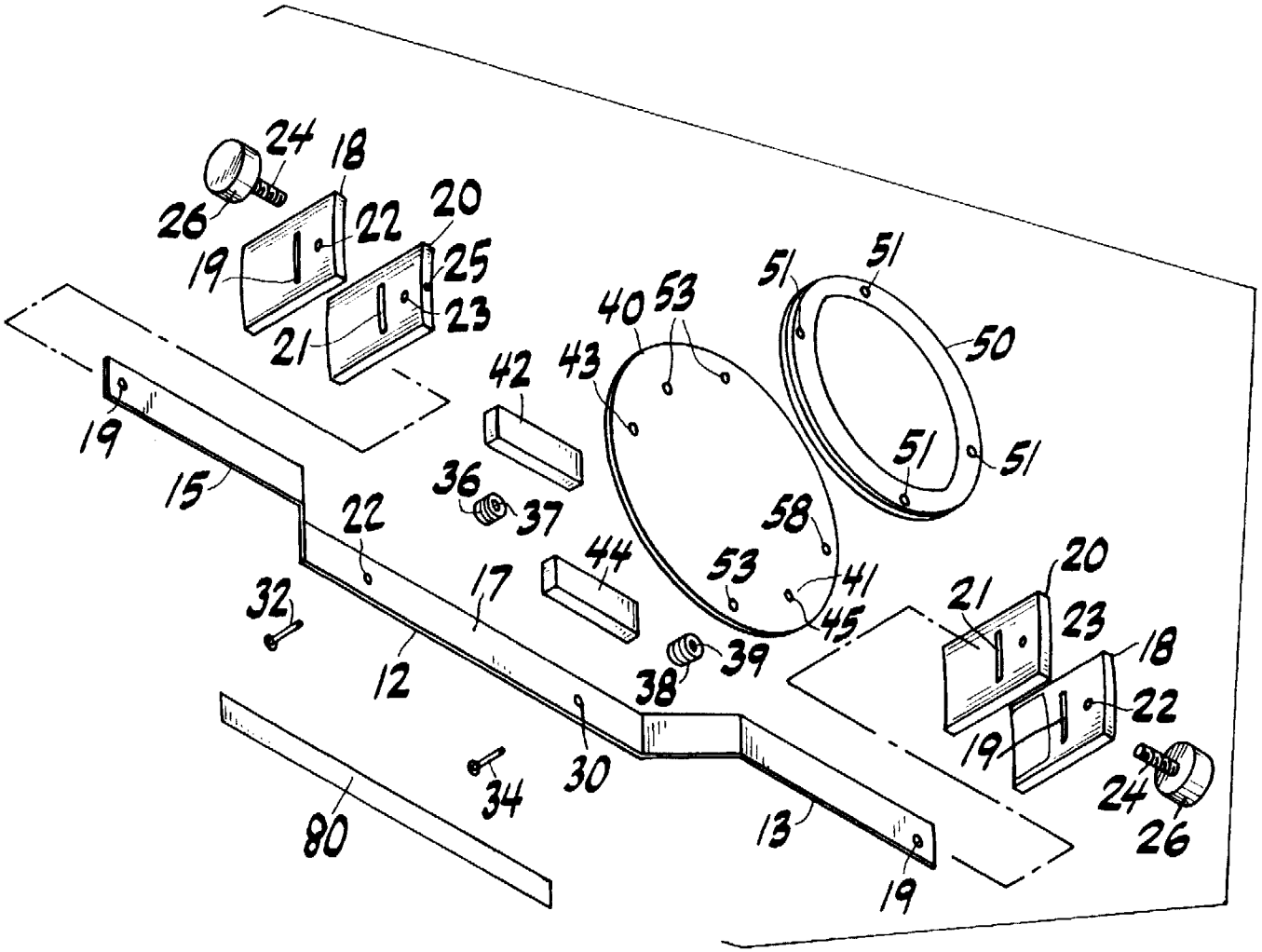
FIG. 2 is an exploded plan view of the drum mute of FIG. 1.
Figure 3:
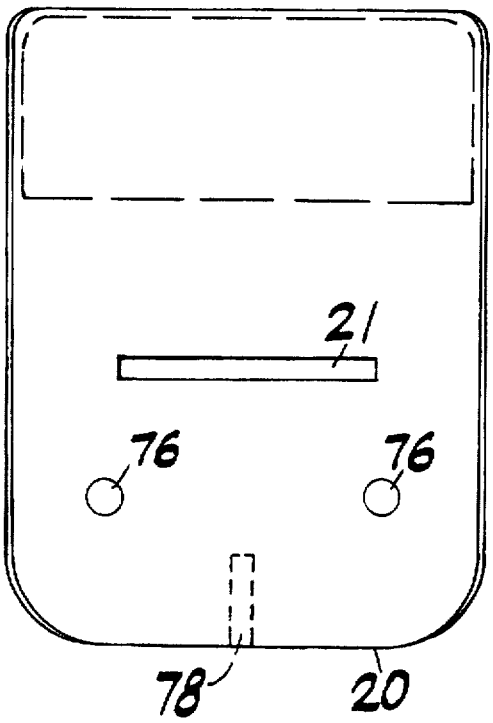
FIG. 3 is a plan view of a bracket clamp of the drum mute of FIG. 1.
Figure 4:
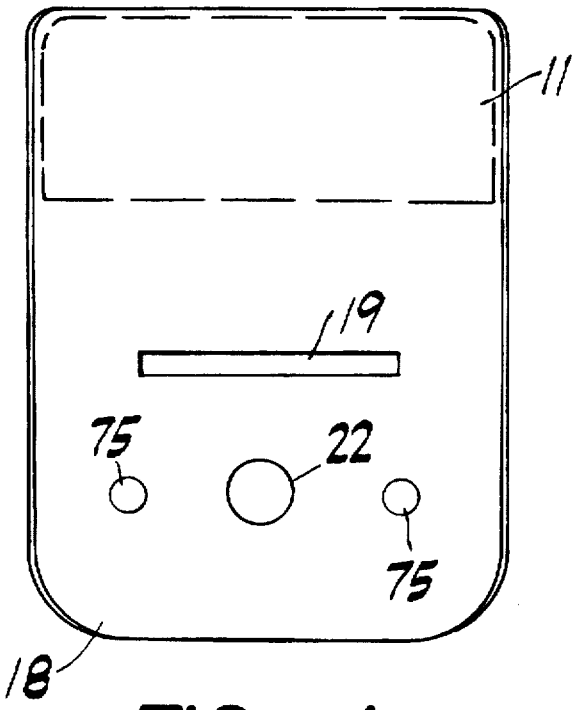
FIG. 4 is a plan view of a second bracket clamp of the drum mute of FIG. 1.

Mounted on either end of support frame 12 are first and second adjustable clamp assemblies 14 and 16. Each adjustable clamp assembly comprises first and second bracket clamps 18 and 20. As illustrated in FIG. 4, first bracket clamp 18 comprises a first rectangular slot 19, a set screw 78, a round through hole 22, and round holes 76. As illustrated in FIGS. 2 and 3, second bracket clamp 20 comprises a second rectangular slot 21, a round hole 23, a threaded hole 25, and dowel pins 75. First rectangular slot 19 and second rectangular slot 21 are sized so that first clamp bar 18 and second clamp bar 20 will slide freely along arm sections 13 and 15 of support frame 12. Dowel pins 75 are sized to mate with round holes 76 in the first bracket clamp 18 in order to steady the clamp assemblies 18 and 20 when the assemblies are tightened. Arm sections 13 and 15 are also provided with through holes 17 with set screws 9 mounted therein. The set screws 9 prevent the clamp assemblies 14 and 16 from sliding off the end of support frame 12.

As illustrated in FIGS. 3 and 4, bracket clamps 18 and 20 are each provided with an insulation pad 11. The insulation pad 11 is rigidly attached to the bracket clamps 18 and 20 by means of an adhesive. In this embodiment, the insulation pads are fabricated from neoprene and the adhesive used is latex contact cement such as 1630 NF clear manufactured by 3M®.

Figure 5:
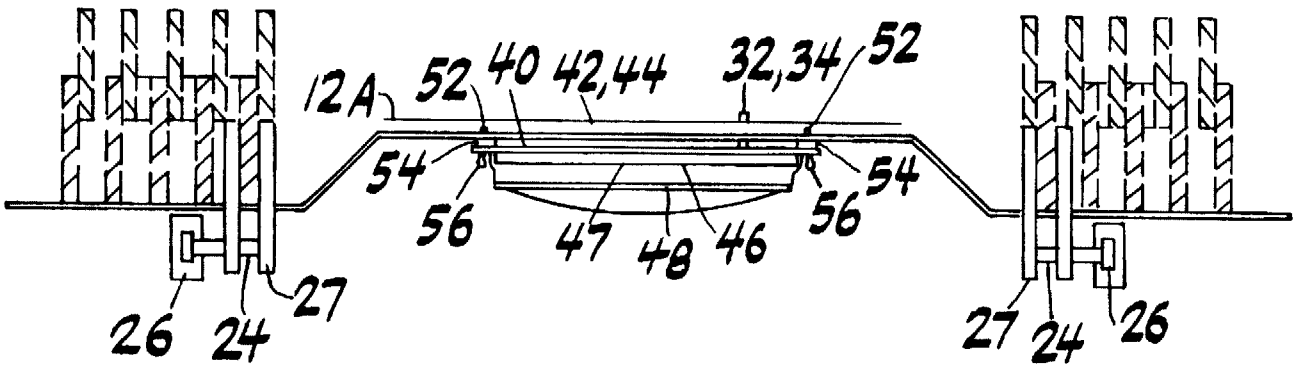
FIG. 5 is a side plan view of the drum mute of the present invention.

The first and second clamp assemblies 14 and 16 are each provided with a set first screw 24. On the end of the first set screws 24 is mounted an aluminum knob 26. Round through holes 22 are sized to slidingly receive the first set screw 24. Aluminum knob 26 is provided with a large enough diameter so that it will not pass through round through holes 22. Round holes 23 are provided with threads that mate with the threads on the first set screws 24. Threaded holes 25 are each provided with a second set screw 27 as illustrated in FIG. 5. The second set screws 27 are used to anchor the first set screws 24 in place in such a manner that the first bracket clamp 18 may be moved along arm sections 13 and 15 relative to the second bracket clamp 20 when the first set screw 24 is rotated.

Support frame 12 is provided with two through holes 28 and 30 in the area of its center arm 17. The through holes 28 and 30 are sized to receive set screws 32 and 34. Mounted on set screws 32 and 34 are two rubber washers 36 and 38. The rubber washers 36 and 38 are provided with through passages 37 and 39 respectively. Set screws 32 and 34 thus pass through the passages 37 and 39 respectively. An insulating sponge 80 is mounted with adhesive to support frame 12 as shown in FIG. 2. Insulating sponge 80 provides insulation between the support frame 12 and the drum head.

A disc 40, fabricated from plexiglass in this embodiment, is also provided. The disc 40 is provided with two through-holes 41 through which the set screws 32 and 34 pass. The set screws 32 and 34 are held in place with locknuts 43 and 45. Two sponge insulation blocks 42 and 44 are mounted with adhesive to the back of disc 40 as illustrated in FIGS. 2 and 5.

A sponge disc 46 is placed on top of disc 40 as illustrated in FIG. 5. The sponge disc 46 in this embodiment has a thickness of approximately 0.5 inch. A second sponge disc 47 is placed on top of sponge disc 46. On top of the sponge discs 46 and 47, a disc 48, fabricated from naugahyde in this embodiment, is placed. The surface on the top of disc 48 is shaped to create a convex playing surface. A metal hoop 50 is placed on top of the disc 48 and holds the disc 48 and sponge disc 46 in place.

The metal hoop 50 is provided with four through holes 51 spaced around its periphery. The disc 40 is also further provided with four through holes 53. The metal hoop 50 is positioned such that the through holes 51 near its periphery are aligned with the through holes 53 in the disc 40. Four tension screws 52 are placed through the holes 51 and 53 as shown in FIG. 5. Rubber washers 54 are placed around tensions screws 52 between the disc 40 and the metal hoop 50. Four acorn nuts 56 are provided as shown in FIG. 5 to hold the tension screws 52 in place.

Figure 6:
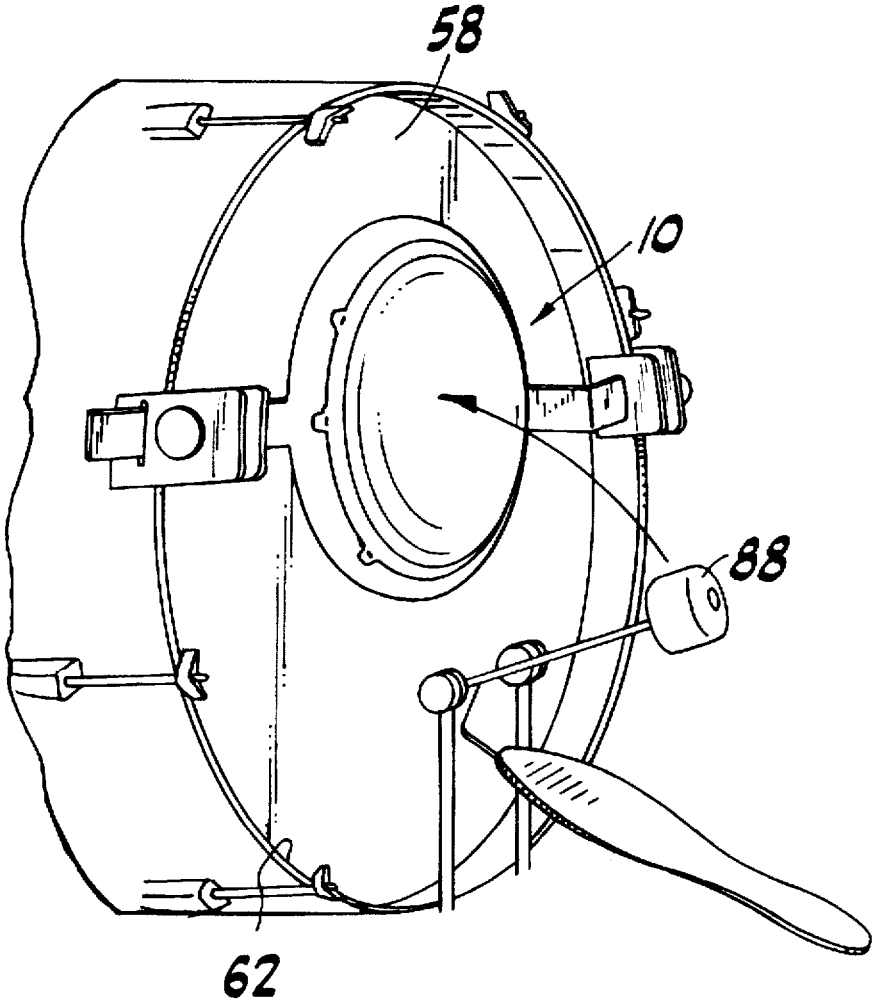
FIG. 6 illustrates the drum mute of the present invention in combination with a bass drum.

FIG. 6 illustrates the drum mute 10 in combination with a bass drum 58. As shown therein, the drum mute 10 is positioned so that arm section 17 of support frame 12 is placed onto the head 60 of bass drum 58. As can be seen from FIG. 6, the head 60 of the bass drum 5 is generally oriented in a vertical position. In this position, the sponge insulation blocks 42 and 44 are also in contact with face 60. The first and second adjustable clamp assemblies 14 and 16 slide along the arms 15 and 13 respectively of support frame 12 so that they are aligned with the rim 62 of bass drum 58. FIG. 5 illustrates a number of locations at which the first and second clamp assemblies 14 and 16 may be located in order to match the diameter of the bass drum rim 62. First set screws 24 are then tightened so that the first bracket clamp 18 and the second bracket clamp 20 are tightened onto the rim 62. Thereby, the drum mute 10 is held firmly in place on the face 60 of bass drum 58.

In use, a beater 82 will strike the disc 48 instead of the head 60 of the drum. The combination of discs and sponges mounted on the center arm section 17 of support frame 12 will absorb the sound volume emanating from the drum without disturbing the natural response and tone of the drum. The convex surface of disc 48 described above helps to prevent the drummer from striking the metal hoop 50 rather than the surface of disc 48. In this manner, the drummer can practice without generating the excessive volume that usually emanates from a drum.

Those of ordinary skill in the art will recognize that the embodiment just described merely illustrates the principles of the present invention. Many modifications may be made thereto without departing from the spirit and scope of the invention as set forth in the following claims.

What is claimed is:

1. A device for muting the sound emanating from a bass drum comprising:

a) a support means comprising a plurality of arm sections;

b) a sound muting means, mounted to the support means and in contact with a head of the bass drum wherein the head of the bass drum is oriented in a vertical position, for muting the sound emanating from the bass drum when the sound muting means is struck by a beater and wherein the plurality of arm sections comprising the support means are in a fixed angular position with respect to the sound muting means; and c) a connecting means slidingly mounted on the plurality of arm sections of the support means for mounting the device on a rim of a bass drum comprising a plurality of adjustable clamp assemblies wherein the plurality of adjustable clamp assemblies being slidingly adjusted along the arm sections of the support means to fit the diameter of the rim of the bass drum and wherein the adjustable clamp assemblies further comprise two opposing surfaces that are adjusted by means of a first set screw to firmly secure the bass drum mute in place.

2. The device of claim 1 wherein the sound muting means comprises a plurality of sound deadening discs and blocks connected to the support means.

3. A drum mute in combination with a bass drum wherein the bass drum comprises a rim and a head and the drum mute comprises a support frame comprising two outer arm sections and a center arm section, a sound muting device mounted to the center arm section of the support frame in contact with the face of the bass drum comprising a plurality of sound deadening discs and blocks, wherein the two outer arm sections comprising the support frame are in a fixed angular position with respect to the sound muting means, and two adjustable clamp assemblies slidingly mounted on the outer arm sections of the support frame and connected to the rim of the bass drum wherein the adjustable clamp assemblies being slidingly adjusted along the arm sections of the support frame to fit the diameter of the rim of the bass drum and wherein the adjustable clamp assemblies further two opposing surfaces that are adjusted by means of a first set screw to firmly secure the bass drum mute in place.

* * * * *